US005535651A

United States Patent [19]

Perez

[11] Patent Number: 5,535,651

[45] Date of Patent: Jul. 16, 1996

[54] EXPANDING ADJUSTMENT TOOL

[76] Inventor: Jose R. Perez, 2336 W. 8th St. 1A, D'Klym, N.Y. 11223

[21] Appl. No.: 385,890

[22] Filed: Feb. 9, 1995

[51] Int. Cl.[6] ..... B25B 11/00

[52] U.S. Cl. ..... 81/484; 81/485; 81/419; 81/420

[58] Field of Search ..... 81/484–488, 3.7, 81/302, 419, 420; 29/217, 219–221, 221.6, 259–266, 225–230, 269

[56] References Cited

U.S. PATENT DOCUMENTS

| | | | |
|---|---|---|---|
| 896,336 | 8/1908 | Swenson | 81/484 X |
| 1,095,054 | 4/1914 | Wiesenfeld | 81/419 X |
| 1,234,967 | 7/1917 | Throp | 81/486 X |
| 1,523,706 | 1/1925 | Newson | 29/221 |
| 1,814,368 | 7/1931 | Chapman | 29/262 X |
| 2,076,834 | 4/1937 | Wszolek | 29/217 |
| 3,426,752 | 2/1969 | Laico | 29/239 X |
| 3,891,185 | 6/1975 | Lett | 81/484 X |
| 5,423,236 | 6/1995 | Bickler | 81/302 |

*Primary Examiner*—D. S. Meislin

[57] ABSTRACT

A tool for adjustably spacing components during an alignment procedure. The inventive device includes a spreader plate pivotally mounted to an engaging yoke. A handle assembly is coupled to the yoke to facilitate manual placement of the yoke and spreader plate between two components to be adjusted. An adjustment assembly is rotatably coupled to the handle assembly for selectively pivoting the spreader plate relative to the yoke to separate the components to a desired spacing.

3 Claims, 3 Drawing Sheets

EXPANDING ADJUSTMENT TOOL

BACKGROUND OF THE INVENTION

1. Field of the Invention

The present invention relates to tool structures and more particularly pertains to an expanding adjustment tool for adjustably spacing components during an alignment procedure.

2. Description of the Prior Art

The use of tool structures is known in the prior art. More specifically, tool structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art tool structures include U.S. Pat. Nos. 5,104,141; 4,970,801; 4,943,253; 4,577,534; 4,420,170; and 3,915,431.

While these devices fulfill their respective, particular objectives and requirements, the aforementioned patents do not disclose an expanding adjustment tool for adjustably spacing components during an alignment procedure which includes a spreader plate pivotally mounted to an engaging yoke, a handle assembly coupled to the yoke for facilitating manual placement of the yoke and spreader plate between two components to be adjusted, and an adjustment assembly rotatably coupled to the handle assembly for selectively pivoting the spreader plate relative to the yoke to separate the components into a desired spaced position.

In these respects, the expanding adjustment tool according to the present invention substantially departs from the conventional concepts and designs of the prior art, and in so doing provides an apparatus primarily developed for the purpose of adjustably spacing components during an alignment procedure.

SUMMARY OF THE INVENTION

In view of the foregoing disadvantages inherent in the known types of tool structures now present in the prior art, the present invention provides a new expanding adjustment tool construction wherein the same can be utilized for adjustably spacing components during an alignment procedure. As such, the general purpose of the present invention, which will be described subsequently in greater detail, is to provide a new expanding adjustment tool apparatus and method which has many of the advantages of the tool structures mentioned heretofore and many novel features that result in a expanding adjustment tool which is not anticipated, rendered obvious, suggested, or even implied by any of the prior art tool structures, either alone or in any combination thereof.

To attain this, the present invention generally comprises a tool for adjustably spacing components during an alignment procedure. The inventive device includes a spreader plate pivotally mounted to an engaging yoke. A handle assembly is coupled to the yoke to facilitate manual placement of the yoke and spreader plate between two components to be adjusted. An adjustment assembly is rotatably coupled to the handle assembly for selectively pivoting the spreader plate relative to the yoke to separate the components to a desired spacing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new expanding adjustment tool apparatus and method which has many of the advantages of the tool structures mentioned heretofore and many novel features that result in a expanding adjustment tool which is not anticipated, rendered obvious, suggested, or even implied by any of the prior art tool structures, either alone or in any combination thereof.

It is another object of the present invention to provide a new expanding adjustment tool which may be easily and efficiently manufactured and marketed.

It is a further object of the present invention to provide a new expanding adjustment tool which is of a durable and reliable construction.

An even further object of the present invention is to provide a new expanding adjustment tool which is susceptible of a low cost of manufacture with regard to both materials and labor, and which accordingly is then susceptible of low prices of sale to the consuming public, thereby making such expanding adjustment tools economically available to the buying public.

Still yet another object of the present invention is to provide a new expanding adjustment tool which provides in the apparatuses and methods of the prior art some of the advantages thereof, while simultaneously overcoming some of the disadvantages normally associated therewith.

Still another object of the present invention is to provide a new expanding adjustment tool for adjustably spacing components during an alignment procedure.

Yet another object of the present invention is to provide a new expanding adjustment tool which includes a spreader plate pivotally mounted to an engaging yoke, a handle assembly coupled to the yoke for facilitating manual placement of the yoke and spreader plate between two components to be adjusted, and an adjustment assembly rotatably coupled to the handle assembly for selectively pivoting the spreader plate relative to the yoke to separate the components into a desired spaced position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
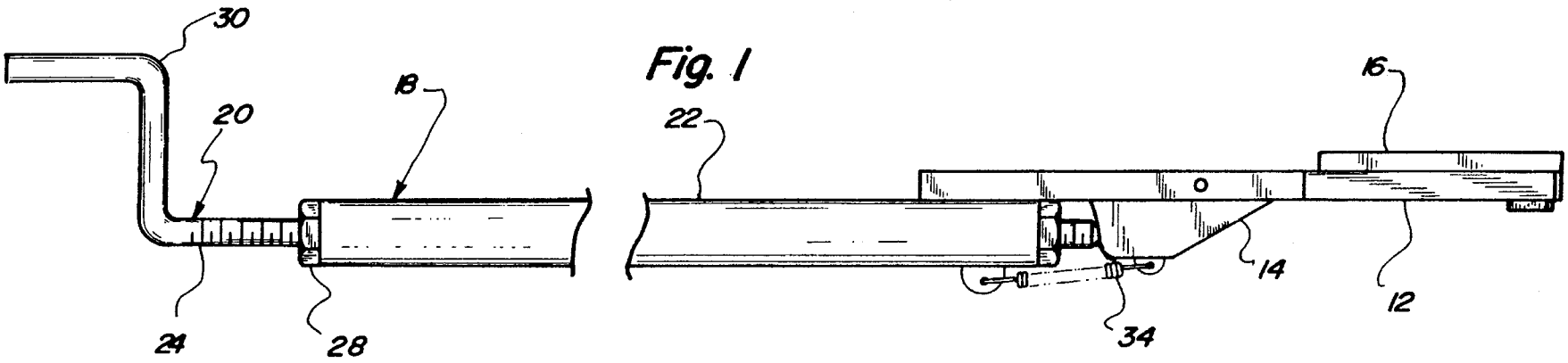
FIG. 1 is a side elevation view of a expanding adjustment tool according to the present invention.

With reference now to the drawings, and in particular to FIGS. 1–5 thereof, a new expanding adjustment tool embodying the principles and concepts of the present invention and generally designated by the reference numeral 10 will be described.

More specifically, it will be noted that the expanding adjustment tool 10 comprises an engaging yoke 12 having a lever arm 14 pivotally mounted relative thereto. A spreader plate 16 is secured to the lever arm 14 and positioned for pivoting from the closed position illustrated in FIG. 1 wherein the spreader plate 16 is positioned into a substantially parallel and abutting orientation relative to the engaging yoke 12 to an open position as illustrated in FIG. 2 wherein the spreader plate 16 is positioned in a spaced and oblique orientation relative to the engaging yoke. A handle means 18 is coupled to the engaging yoke 12 for facilitating manual manipulation thereof to place the spreader plate 16 and the engaging yoke between two components to be adjusted. An adjustment means 20 is rotatably coupled to the handle means 18 and operates for facilitating manual adjustment of the position of the spreader plate 16 relative to the engaging yoke 12. By this structure, the spreader plate 16 and the engaging yoke 12 can be selectively positioned between two components to be adjusted, wherein an actuation of the adjustment means 20 will effect opening or spacing of the spreader plate 16 relative to the engaging yoke to adjustably position the components into a desired spacing.

Figure 2:
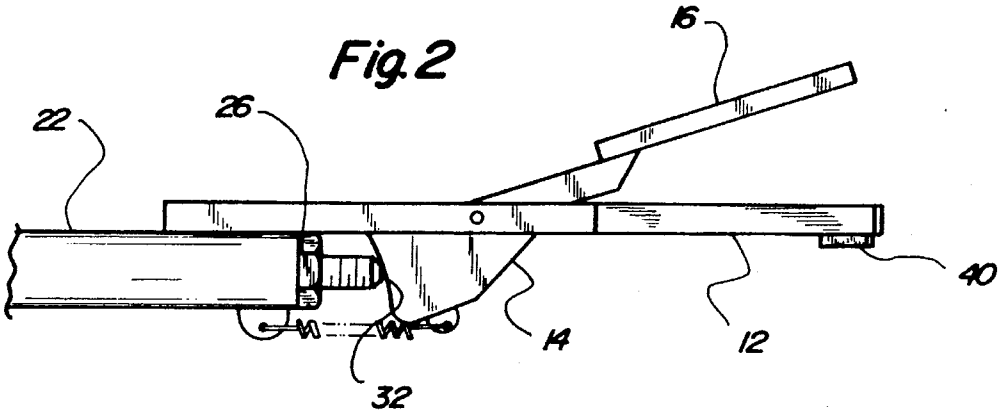
FIG. 2 is an enlarged side elevation view of a portion of the present invention.
Figure 3:
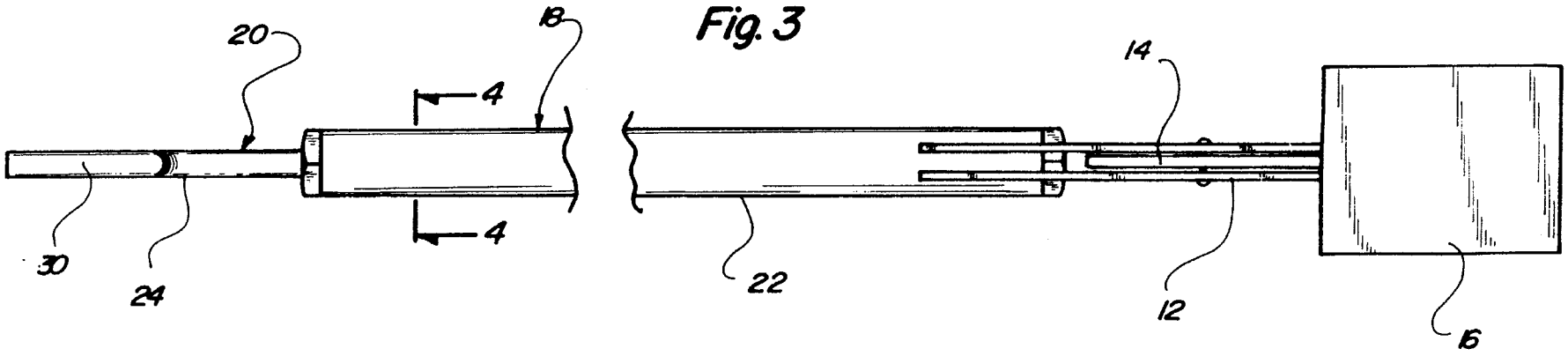
FIG. 3 is a top plan view of the device.
Figure 4:
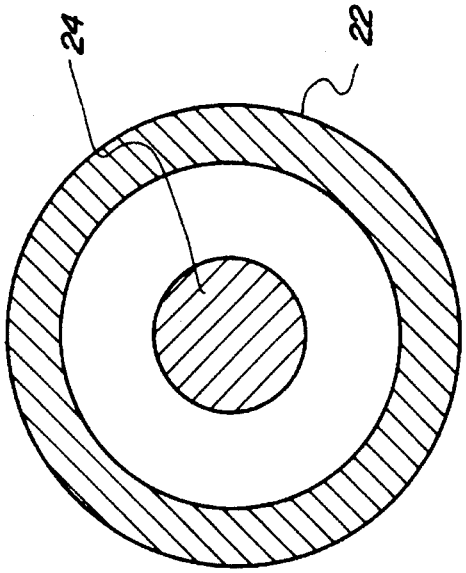
FIG. 4 is a cross sectional view taken along line 4–4 of FIG. 3.

As best illustrated in FIGS. 1 through 3, it can be shown that the handle means 18 according to the present invention 10 preferably comprises a handle tube 22 to which the engaging yoke 12 is secured. Preferably, the engaging yoke 12 is secured to an exterior surface of the handle tube 22 by a mechanical fastening means such as welding, riveting, or the like. The handle tube 22 of the handle means 18 can be of any desired length to facilitate remote placement of the spreader plate 16 and the engaging yoke 12 between two components to be adjusted.

As best illustrated in FIGS. 1 through 5, it can be shown that the adjustment means 20 according to the present invention 10 preferably comprises a threaded rod 24 extending through a hollow interior of the handle tube 22. The threaded rod 24 is threadably engaged to a first threaded boss 26 secured to an end of the handle tube 22 proximal to the engaging yoke 12. A second threaded boss 28 can also be provided and secure to a second end of the handle tube 22 to impart further stability to the threaded rod 24 of the adjustment means 20. A crank 30 extends from the threaded rod 24 proximal to the second end of the handle tube 22 and can be selectively manually rotated to effect axial movement of the threaded rod 24 relative to the handle tube 22 as a result of the threaded engagement between the threaded rod and the first and second threaded boss 26 and 28. A free distal end of the threaded rod 24 is positioned for engagement against a portion of the lever arm 14, whereby an advancement of the threaded rod 24 relative to the handle tube 22 will effect pivoting of the lever arm 14 relative to the engaging yoke 12. Preferably and as shown in FIG. 2, the lever arm 14 is shaped so as to define an arcuate cam surface 32 against which the free distal end of the threaded rod 24 engages. By this structure, a rotation of the crank 30 will effect axial movement of the threaded rod 24 relative to the handle tube 22 to pivot the lever arm 14 relative to the engaging yoke 12. To facilitate return of the lever arm 14 towards the engaging yoke 12 during reverse motion of the crank 30, a return spring 34 is coupled between a portion of the lever arm 14 and the handle tube 22 so as to bias the lever arm 14 into the normally closed configuration illustrated in FIG. 1.

Figure 5:
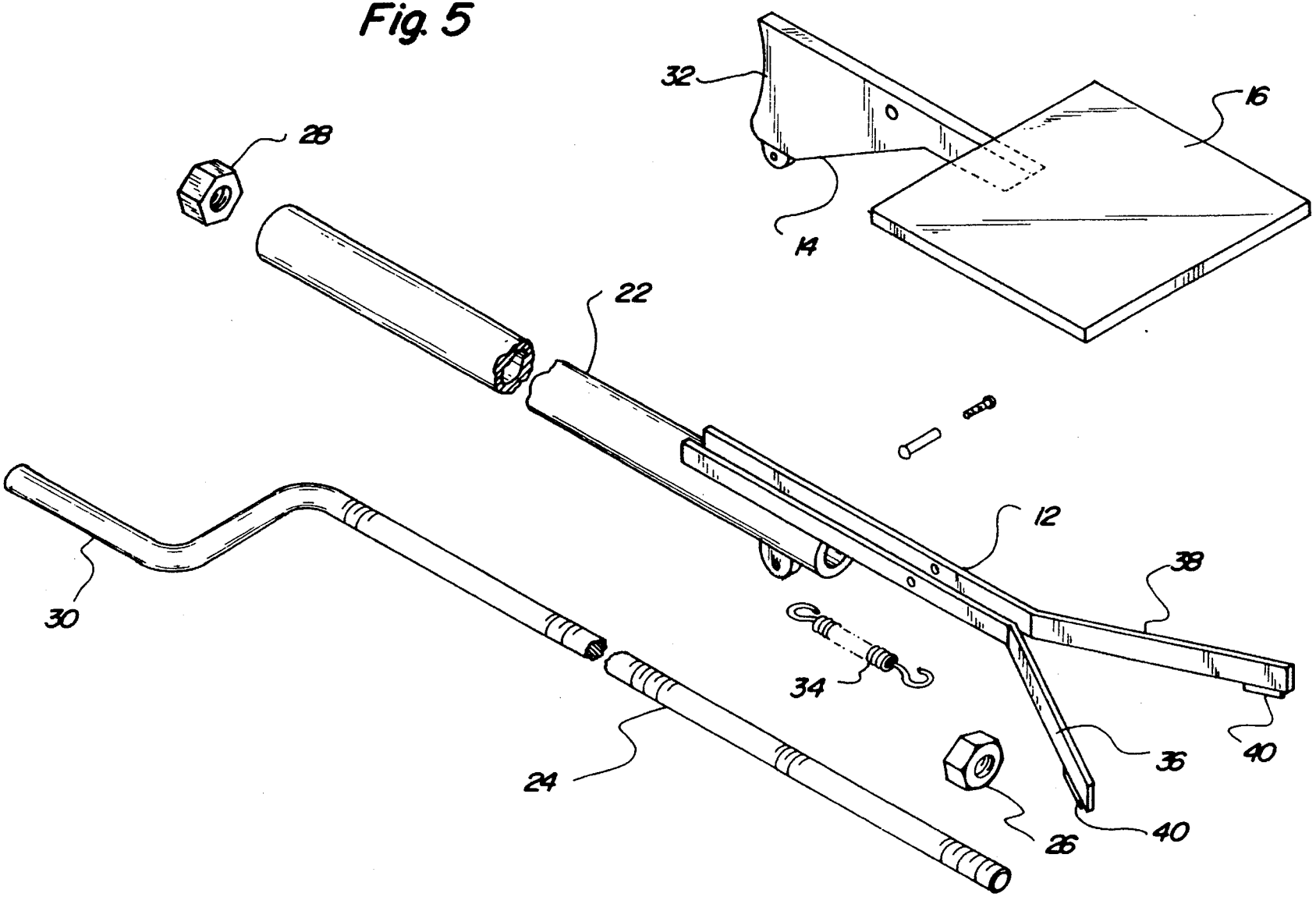
FIG. 5 is an exploded isometric illustration of the invention.

As shown in FIGS. 2 and 5, the engaging yoke 12 according to the present invention 10 is preferably comprised of a pair of spaced yoke arms secured to the handle tube 22 as described above. To this end, the yoke 12 comprises a first yoke arm 36 and a second yoke arm 38. The yoke arms 36 and 38 each include a substantially straight portion extending substantially parallel to one another, and an angled portion extending in an oblique angle relative to one another. Thus, the engaging yoke 12 is of a first transverse dimension proximal to the handle tube 22, and tapers to a second transverse dimension spaced from the handle tube 22, wherein the second transverse dimension in substantially greater than the first transverse dimension to define a widened mouth of the engaging yoke 12. To enhance frictional engagement of the engaging yoke 12 relative to a component to be adjusted, each of the yoke arms 36 and 38 may each be provided with an engaging pad 40 secured to a distal end thereof. By this structure, the engaging yoke 12 and the spreader plate 16 can be positioned between two components to be adjusted, whereby the engaging yoke 12 will be discouraged from sliding movement relative to one of the components.

In use, the expanding adjustment tool 10 according to the present invention can be easily utilized during an adjustment procedure, such as setting the camber of the struts of an automobile, to effect spacing of two components as desired.

The spreader plate 16 and the engaging yoke 12 can be simply be positioned between the two components, whereby a rotation of the crank 30 in a first direction causing axial movement of the threaded rod 24 through the handle tube 22 and into contact with the lever arm 14 will effect pivoting of the spreader plate 16 relative to the engaging yoke 12 to space the components apart. Further, a rotation of the crank 30 in a second direction effecting axial movement of the threaded rod 24 relative to the handle tube 22 away from the lever arm 14 will permit the return spring 34 to bias the spreader plate towards the engaging yoke 12 to allow the components to become closer together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An expanding adjustment tool comprising: an engaging yoke having a pair of spaced yoke arms including substantially straight portions extending substantially parallel to one another and angled portions extending outwardly at an oblique angle relative to one another;

a lever arm pivotally mounted relative to said engaging yoke, said lever arm having a laterally extending projection therefrom intermediate the ends thereof, said projection having one surface defining an arcuate cam surface;

a spreader plate secured to the lever arm and positioned for pivoting from a closed position wherein the spreader plate is in a substantially parallel and abutting orientation relative to the engaging yoke to an open position wherein the spreader plate is in a spaced and oblique orientation relative to such yoke;

a handle means having a handle tube coupled to the engaging yoke to facilitate manual manipulation thereof to place the spreader plate and the engaging yoke between two components to be adjusted;

and, an adjustment means comprising a threaded rod extending through a hollow interior of said handle tube, said threaded rod being axially advanceable relative to the handle tube in response to a rotation thereof relative to said handle tube; and a crank extending from a first end of the threaded rod and a free distal end of said threaded rod is positioned for engagement against the arcuate cam surface of said laterally extending projection of said lever arm.

2. A tool as in claim 1, wherein the adjustment means further comprises a return spring affixed at one end to a portion of said lever arm and at the other end to said handle tube.

3. A tool as in claim 1 wherein a frictional surfaced engaging pad is secured to a distal end of each of the yoke arms.

* * * * *